US006916381B2

(12) United States Patent
Granguillhome et al.

(10) Patent No.: US 6,916,381 B2
(45) Date of Patent: Jul. 12, 2005

(54) PROCESS FOR THE PRODUCTION OF INVERT LIQUID SUGAR

(76) Inventors: Enrique R. Cárdenas Granguillhome, Lago Zumpango 5118, C.P., Monterrey (MX), 64890; José Angel Cárdenas Barrañon, Lago Zumpango 5118, C.P., Monterrey (MX), 64890; Juan José González Garza, Aurora 247, Col. Centro, C.P., Monterrey (MX), 64860

( * ) Notice: Subject to any disclaimer, the term of this patent is extended or adjusted under 35 U.S.C. 154(b) by 108 days.

(21) Appl. No.: 10/464,837

(22) Filed: Jun. 19, 2003

(65) Prior Publication Data

US 2004/0255934 A1 Dec. 23, 2004

(51) Int. Cl.[7] ..... C13D 3/08; C13K 3/00

(52) U.S. Cl. ..... 127/51; 127/46.2; 127/48; 127/55; 435/105

(58) Field of Search ..... 127/46.2, 48, 51, 127/55; 435/105

(56) References Cited

U.S. PATENT DOCUMENTS 3,340,093 A * 9/1967 Cortis-Jones et al. ..... 127/30
6,068,869 A * 5/2000 Bent Ginslov ..... 426/262

* cited by examiner

*Primary Examiner*—David Brunsman
(74) *Attorney, Agent, or Firm*—Finnegan, Henderson, Farabow, Garrett & Dunner, LLP

(57) ABSTRACT

A process for the production of liquid sugar by forming a sugar solution of water and natural sugar containing juice, adjusting the pH of a sugar solution to the range of from 1.0 to 2.0 to obtain an inverted juice, filtering the inverted juice, decolorizing the inverted juice to obtain sugar syrup, demineralizing the sugar syrup, evaporating the demineralized sugar syrup, and cooling the sugar syrup to form the liquid sugar.

26 Claims, No Drawings

PROCESS FOR THE PRODUCTION OF INVERT LIQUID SUGAR

CROSS REFERENCE TO RELATED APPLICATIONS

This application is related to Mexican patent application NL/9/2001/000011, filed Apr. 18, 2001, the subject matter of which is incorporated by reference herein.

FIELD OF THE INVENTION

The present invention is related to processes for the production of liquid sugar, and more particularly to a process for the production of liquid sugar which avoids the need of producing final sugar and other waste materials commonly produced in the traditional sugar production processes, and reduces the thermal and electrical energy consumption compared to conventional processes for the production of crystal sugar that ordinarily need a great amount of vapor and electricity for its production.

DESCRIPTION OF RELATED ART

There is currently an over-supply and an over-production of crystal sugar, which causes a low selling price that affects the financial health of the sugar industry. In addition, there is a tendency in the food industry to substitute corn syrup, which is fructose rich, for crystal sugar, especially in the beverage industry. This causes an additional depression of crystal sugar prices in the worldwide market.

The conventional process for the production of crystal sugar from sugar cane comprises the following steps:

reducing the cane size by means of a grinding machine. Normally such machines have a cutting blade rotating at a velocity of between about 400 to 500 rpm in order to extract the juice of the sugar cane by extrusion;

adding from 25 to 35% by weight of "imbibition" water to the raw sugar cane juice at a temperature of 75 to 85° C. to assure an efficient sucrose extraction of from 95 to 98.5%;

submitting the juice obtained in the last step to a purification process known as defecation consisting in the addition of 0.5 Kgs of calcium hydroxide by each ton of cane, to raise the pH of the juice to a pH of from 7.5 to 8.5;

feeding the juice to a heat interchanger to raise the temperature to 90–105° C., to precipitate the resin gum serums and albuminoidal substances;

feeding the obtained juice to a continuous clarifier and evaporator to separate the liquid from the solids, called sedimentation sludge (The sedimentation sludge is passed to a continuous rotary filter in which a sugar solution is recovered. The obtained precipitation product has a sugar content of from 0.8 to 1.2 % in weight);

pumping the sugar solution having a sucrose content of from 12 to 15% to a multiple effect evaporator (from two to three effects), wherein a solid concentration of from 60 to 65% is achieved;

crystallizing the solids obtained in the last step inside a one effect intermittent evaporator until obtaining a solid concentration of from 85 to 90% to obtain a boiled mass containing crystal sugar (This is the most expensive step since a bad crystallization may provoke an increase of the production of non-crystallizable product (molasses), which is a by product that consumes as much as from 10 to 15% of the total cane sugar content);

centrifuging the boiled mass inside cans rotating at 1000 to 1800 RPM to separate the sugar crystals from the mass;

washing the sugar crystals with atomized water in order to separate the molasses from the sugar crystals; and drying the sugar crystals by means of a rotary dryer to obtain raw sugar ready for a refining process.

The refining process comprise the following steps:

mixing raw sugar with syrup having a solid content of from 72 to 75° Brix inside a mixer having a rotary agitator for eliminating the molasses from the sugar crystals;

centrifuging the mixture of syrup and raw sugar to separate the clean sugar crystals from the syrup; and dissolving the crystals in water to obtain a solution having a concentration of from 55 to 60° Brix.

The purification of the solution comprises the steps of:

clarification;

filtration; and de-coloration in order to obtain a de-colored (clear) solution. The clarification is carried out by carbon phosphate, whitewashing, filtration and discoloration;

crystallization: the de-colored solution is evaporated to obtain a solid concentration of form 85 to 90° Brix and then it is sent to an agitated tank; where it is centrifuged for separating refined sugar crystals form the solution;

washing: the refined sugar crystals are washed with hot water and the washing water is recycled to the crystallization step;

drying: the washed refined sugar crystals are dried with a countercurrent hot air stream inside a rotary drier until obtaining a water content of 0.05% in weight.

The main disadvantage of the above process is the production of a final solution and molasses having a high content of non-processed sugar. Moreover, in order to carry out the crystallization of the sugar, the traditional process consumes a great amount of energy (vapor and electricity).

Furthermore, the traditional process requires cutting the crest of the cane, since this part of the cane contains no crystallizable monosaccharide sugars that would raise the weight of the recollected cane for as much as 20 to 25%.

In view of the above-referred disadvantages and of the need in the food industry for an alternative to the corn syrup, applicants developed a process for the production of liquid sugar.

The process of the present invention obtains a final product comprising liquid sugar having a fructose content of 50% in weight and a high efficiency of extraction sugar solids content of from 69 to 75% in weight.

The process of the present invention is able to treat the crest of the cane thus using all the cane and reducing the amount of waste material.

Furthermore, the process of the present invention has fewer steps compared with the traditional process, thus reducing the quantity of needed equipment.

Finally, thanks to the process of the present invention, more sugar is produced using the same amount of energy and cane compared with the traditional process, and the production of molasses is eliminated.

SUMMARY OF THE INVENTION

It is therefore an object of the present invention to provide a process for the production of liquid sugar containing 50% of fructose and from 69% to 75% of high efficiency process of extraction sugar cane solids.

It is another object of the present invention to provide a process of the above referred nature for producing more sugar by using the same amount of energy and cane compared with the traditional process.

It is still another object of the present invention to provide a process of the above referred nature which is able to treat the crest of the cane, thus using all the cane and reducing the amount of waste material.

It is a further object of the present invention to provide a process of the above referred nature that has less steps compared with the traditional process, thus reducing the quantity of needed equipment.

It is an additional object of the present invention to provide a process of the above referred nature that produces more sugar by using the same amount of energy and cane compared with the traditional process and eliminates the production of molasses.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

To meet such objectives there is provided a new process for the production of liquid sugar. The process includes the step of forming a sugar solution of imbibition water and natural sugar containing juice, preferably the juice from sugar cane. The pH of the natural sugar containing juice is adjusted to the range of from 1.0 to 2.0 to obtain an inverted juice. The inverted juice is filtered and the juice decolorized to obtain a sugar syrup. The sugar syrup is demineralized, evaporated, and cooled to form the liquid sugar.

DETAILED DESCRIPTION OF THE INVENTION

The invention will now be described in accordance with a preferred embodiment thereof and to an specific example of the results of the process of the present invention.

The process for the production of liquid sugar of the present invention may include the following steps:

grinding the cane by means of a grinding machine having a cutting blade rotating at a velocity of between about 400 to 500 rpm in order to break the cane's bark and reduce the cane's size;

mixing the ground cane with imbibition water in an amount of from 25% to 35% by weight inside a diffusion-extraction unit comprised of a one to five stage diffusion unit and a four masses mill inside of which the ground cane is mixed with a countercurrent stream of imbibition water at a temperature of from 60 to 75° C.;

extracting the juice from the cane mixed with imbibition water by means of an extractor mill capable of exerting a pressure of from 120 to 150 kgs/cm$^2$ by which is extracted the 55% of the diluted solution from the cane which equals to the extraction of the 98.50% of the total sugar content thus obtaining a solution of cane juice mixed with imbibition water having a concentration of from 12 to 15° Brix;

adjusting the pH of the solution obtained in the last step at 1.0 to 2.0 by pre-heating it at a temperature of approximately from 90 to 100° C. inside a heat interchanger and then discharging the solution into an agitated reactor made of stainless steel and adding mineral acids such as sulfuric acid, phosphoric acid and hydrochloric acid. Other organic acids that can be used include, for example, acetic, propionic, tartaric, sucinic, citric and invertase enzyme. The residence time of the solution inside the reactor must be of from 45 to 75 minutes by which is obtained an inverted juice at a 100%; purifying the inverted juice by firstly adjusting its pH at 5.5 to 6.5 by adding a lime slurry inside a tank type agitated neutralizer reactor inside of which the temperature is maintained at between about 90 to 100° C., and then discharging the juice to a continuous clarifier at the bottom of which a precipitated is settled which is filtered from the juice by means of a rotary filter in order to mix the juice filtered at the bottom of the clarifier with the clarified juice that is discharged by the continuous clarifier's superior end to a balance tank inside of which the temperature is maintained at a temperature of between about 70–80° C. in order to obtain a purified inverted juice;

decolorizing the purified inverted juice in order to obtain a discolored syrup by feeding it to a tandem of decolorizing activated carbon columns of mineral or vegetal origin and then feeding the decolorized syrup to a balance tank into which the temperature of the syrup is reduced at between about 40 to 50° C. for continuously feeding it to the next step;

demineralizating the syrup by feeding it to a demineralizating column tandem comprised of: a weakly basic macro reticular and micro porous anionic resin column, a strongly acidic resin column and a weakly basic anionic resin column, controlling the exit pH between a range of from 5.5 to 6.5 , and subsequently discharging the demineralized syrup to a balance tank wherein the temperature is raised at between about 70 to 80° C.;

evaporating the demineralized syrup by means of a descending film evaporator of triple effect and five bodies (specific for fruit juices) for avoiding the overheating of the sugar solution and the formation of colored substances that reduce the quality of the final product operating at a vacuum negative pressure of 26 inches of Hg at a temperature of between about 110 to 120° C. in order to obtain a final syrup having a final concentration of 75° Brix having fructose content of 50% in weight;

and lowering the syrup temperature by means of a heat interchanger at a temperature of between about 30 to 35° C.; sending the cooled syrup to a storage tank.

The storage tank should be made of stainless steel sanitary grade having an inert gas pressure of between about 0.05 to 0.1 atm. The inert gas may be nitrogen, carbonic anhydride or a mix thereof.

EXAMPLE

In order to exemplify and comparing the performance of the process for producing liquid sugar of the present invention, the following operational data from the "Plan de Ayala" traditional sugar refinery located in Cd. Valles S.L.P México, was obtained from the "Manual Azucarero Mexicano" of the year 2000, taking as comparison parameters a ton of refined sugar versus a ton of liquid sugar having a concentration of 75° Brix.

Comparison parameters from the traditional process for the production of refined sugar compared with the process of the present invention.

| | Comparison base | |
|---|---|---|
| | 1000 Kgs of crystalline sugar | 1000 Kgs of liquid |
| | Comparison parameter | |
| | Traditional process | Process of the present invention |
| cane sugar | 9.4561 | 6.0374 |
| Tons of molasses | 0.3405 | Non produced |
| Tons of cachaza | 0.3044 | Non produced |
| Tons of vapor | 3.3159 | 2.020 |

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A process for the production of liquid sugar comprising the steps of:

forming a sugar solution of imbibition water and natural sugar containing juice;

adjusting the pH of said sugar solution to the range of from 1.0 to 2.0 to obtain an inverted juice;

filtering said inverted juice;

decolorizing said inverted juice to obtain sugar syrup;

demineralizing said sugar syrup;

evaporating said demineralized sugar syrup; and cooling said sugar syrup to form said liquid sugar.

2. The process of claim 1 where said natural sugar containing juice consists essentially of a juice obtained from: sugar cane, sugar beet, fruit, or mixtures thereof.

3. The process of claim 1 where said sugar solution has a water content of from 25 to 35% by weight.

4. The process of claim 1 where said liquid sugar has a fructose content of up to 50% in weight and a sugar solids concentration of up to 75° Brix.

5. The process of claim 1 wherein said sugar syrup is cooled to a temperature in the range of from 30 to 35° C. to form said liquid sugar.

6. The process of claim 1 wherein said liquid sugar is stored in a stainless steel container under an inert gas.

7. The process of claim 6 wherein said liquid sugar is stored under an inert gas at a pressure of about 0.05 to 0.1 atm.

8. A process for the production of liquid sugar according to claim 1, wherein the solution of imbibition water and natural sugar containing juice is formed by:

grinding sugar cane by means of a grinding machine having at least one cutting blade rotating at a velocity of between about 400 to 500 rpm in order to break the cane's bark and reduce the cane's size to form around cane;

mixing the ground cane with imbibition water in an amount of from 25% to 35% by weight inside an diffusion-extraction unit inside of which the ground cane is mixed with a countercurrent stream of imbibition water at a temperature of from 60 to 75° C.; and extracting the juice from the cane mixed with imbibition water by means of an extractor mill capable of exerting a pressure of from 120 to 150 kgs/cm$^2$ by which is extracted a diluted sugar solution from the cane to obtain a solution of cane juice mixed with imbibition water having a concentration of from 12 to 15° Brix.

9. A process for the production of liquid sugar according to claim 8, wherein said diffusion-extraction unit comprises a one to five stage, four mass mill.

10. A process for the production of liquid sugar according to claim 8, wherein said extraction step extracts over 98% of the total sugar content of the cane.

11. A process for the production of liquid sugar according to claim 1 wherein the solution of imbibition water and natural sugar containing juice has a concentration of from 12 a 15° Brix.

12. A process for the production of liquid sugar according to claim 1, wherein the adjusting step is carried out by heating the solution of imbibition water and natural sugar containing juice until achieving a temperature of approximately from 90 to 100° C. inside a heat exchanger and then discharging the solution into an agitated reactor made of stainless steel and adding mineral or organic acids for a residence time of from 45 to 75 minutes.

13. A process for the production of liquid sugar according to claim 12, wherein the mineral acids are selected from the group consisting of sulfuric acid, phosphoric acid and hydrochloric acid.

14. A process for the production of liquid sugar according to claim 12, wherein the organic acids are selected from the group consisting of acetic acid, propionic acid, tartaric acid, succinic acid and citric acid and invertase enzyme.

15. A process for the production of liquid sugar according to claim 1, wherein the filtering step is carried out by: adjusting the pH of the inverted juice to be in the range of from 5.5 to 6.5 by adding a lime slurry at a temperature in the range of between about 90 to 100° C., and then discharging the juice to a continuous clarifier, at the bottom of which a precipitate is settled which is filtered from the juice, and at the juice discharge end of which clarified juice is discharged, mixing the juice filtered at the bottom of the clarifier with the clarified juice that is discharged from the discharge end of the continuous clarifier to a balance tank inside of which the temperature is maintained at a temperature of between about 70–80° C.

16. A process for the production of liquid sugar according to claim 15, wherein said filtering step is carried out by means of a rotary filter.

17. A process for the production of liquid sugar according to claim 1, wherein the decolorizing step is carried out by feeding the inverted juice to a tandem of activated carbon columns of and then feeding the decolorized syrup to a balance tank into which the temperature of the syrup is reduced to between about 40 to 50° C.

18. A process for the production of liquid sugar according to claim 17, wherein said activated carbon column includes activated carbon of mineral or vegetable origin.

19. A process for the production of liquid sugar according to claim 1, wherein the demineralizing step is carried out by feeding the sugar syrup to tandem demineralizating columns comprised of: a weakly basic anionic resin column, a strongly acidic resin columns, and a weakly basic anionic resin column, controlling the exit pH between a range of from 5.5 to 6.5, and subsequently discharging the demineralized syrup to a balance tank wherein the temperature is raised to between about 70 to 80° C.

20. A process for the production of liquid sugar according to claim 19, wherein said demineralizing step is carried out by means of a weakly basic macro reticular anionic resin column.

21. A process for the production of liquid sugar according to claim 19, wherein said demineralizing step is carried out by means of a weakly basic microporous anionic resin column.

22. A process for the production of liquid sugar according to claim 1, wherein the evaporating step is carried out by means of an evaporator operating at a vacuum negative pressure of 26 inches of Hg at a temperature of between about 120 to 130° C.

23. A process for the production of liquid sugar according to claim 1, wherein the cooling step is carried out by means of a heat exchanger.

24. A process for the production of liquid sugar according to claim 1, wherein the sugar syrup is stored in a stainless steel sanitary grade tank having an inert gas pressure of between about 0.05 to 0.1 atm.

25. A process for the production of liquid sugar according to claim 1, wherein the sugar syrup is stored in a stainless steel sanitary grade tank having an inert gas pressure of between about 0.05 to 0.1 atm, wherein the inert gas comprises a gas selected from the group consisting of: nitrogen, carbonic anhydride or a mix thereof.

26. A process for the production of liquid sugar from sugar cane, said process comprising;

forming a sugar solution of imbibition water and sugar cane juice by grinding the sugar cane to form ground cane, mixing the ground cane with imbibition water in an amount of from 25% to 35% in by weight at a temperature of from 60 to 75° C., and extracting the juice to obtain a sugar solution having a concentration of from 12 to 15° Brix;

adjusting the pH of said sugar solution by heating the sugar solution to a temperature of approximately from 90 to 100° C. and then discharging the solution into a vessel and adding at least one acid to obtain a pH in the range of from 1.0 to 2.0 and thereby form an inverted juice;

filtering said inverted juice by adjusting the pH of the inverted juice to be in the range of from 5.5 to 6.5 at a temperature in the range of between about 90 to 100° C., and then discharging the juice to a separating device, where particulate solids are separated from the juice, the clarified inverted juice from the separating device being collected and maintained at a temperature of between about 70–80° C.;

decolorizing said inverted juice to obtain sugar syrup by feeding the inverted juice to a tandem of activated carbon columns and then feeding the decolorized syrup into a tank in which the temperature of the syrup is reduced to between about 40 to 50° C.;

demineralizing said sugar syrup by feeding the sugar syrup to an anionic resin column, controlling the exit pH to be between 5.5 to 6.5 and subsequently raising the temperature of the demineralized sugar syrup to between about 70 to 80° C.;

evaporating said demineralized sugar syrup by an evaporator operating at a negative pressure and a temperature of between about 120 to 130° C.; and cooling said sugar syrup to form said liquid sugar.

* * * * *